US005284102A

United States Patent [19]

Thomason

[11] Patent Number: 5,284,102

[45] Date of Patent: Feb. 8, 1994

[54] FUME INCINERATOR WITH BAFFLE

[75] Inventor: Michael C. Thomason, Ann Arbor, Mich.

[73] Assignee: Salem Industries, Inc., South Lyon, Mich.

[21] Appl. No.: 920,245

[22] Filed: Jul. 27, 1992

[51] Int. Cl.[5] ..... F23G 7/06; F23G 5/00

[52] U.S. Cl. ..... 110/210; 432/72; 110/211; 110/254

[58] Field of Search ..... 110/210, 211-213, 110/254; 432/72

[56] References Cited

U.S. PATENT DOCUMENTS

| | | | |
|---|---|---|---|
| 2,171,535 | 9/1939 | Berg et al. | 110/254 |
| 3,754,869 | 8/1973 | Van Raden | 110/210 |
| 4,377,116 | 3/1983 | Satake | 110/210 |
| 4,385,568 | 5/1983 | Murray | 110/210 |
| 4,771,707 | 9/1988 | Robson et al. | 110/254 |
| 5,161,966 | 11/1992 | Obermueller | 110/211 |

*Primary Examiner*—Henry C. Yuen
*Attorney, Agent, or Firm*—Lyman R. Lyon

[57] ABSTRACT

A single unit, shell and tube fume incinerator utilizes a baffle (34) structure proximate a combustion zone (24) to control the flow of combustion exhaust gas. The baffle (34) is located proximate the hot ends of a plurality of heat exchange tubes (20) to deflect the hot exhaust gases from the combustion zone (24) away from the ends of the tubes (20), and back to the outside of the tubes (20), thereby controlling the "time at temperature" for contaminants in the impure gas feed. Baffle (34) provides a slip fit around tubes (20) to permit thermal expansion thereof.

3 Claims, 1 Drawing Sheet

FUME INCINERATOR WITH BAFFLE

BACKGROUND OF THE INVENTION

The present invention relates generally to incinerator systems for the abatement of process emissions containing carbonaceous impurities such as volatile organic combustibles (VOC).

Noxious fumes, waste gases or process emissions, which may be termed "feed gas", "waste gas" or "emissions" generally contain volatile organic combustible (VOC) contaminants (carbonaceous impurities). However, the amount of combustible material contained in such emissions is generally below several thousand ppm and, accordingly, will not ignite or propagate a flame at ambient temperature.

Incinerators increase the temperature of such emissions to a level above the ignition temperature of the combustible contaminants by the use of heat derived from a supplemental energy source thereby to oxidize the emission. Regenerative incinerators recover heat remaining in the cleansed exhaust gas to increase the temperature of emissions entering the incinerator thereby minimizing the amount of fuel used by the supplemental energy source to raise the emission to its ignition temperature.

In a typical single unit shell and tube heat exchanger the impure gases flow upwardly through the interior of a plurality of tubes to a combustion chamber. The plurality of tubes are generally affixed to the incinerator as by welding to a tube sheet proximate the combustion chamber. Fuel is burned in the combustion chamber which typically raises the temperature of the impure gases to about 1400° F. (760° C.) where the VOC's are oxidized to $CO_2$ and $H_2O$. The hot gases are then returned to the heat exchanger by downwardly flowing around the outside of the plurality of tubes. However, impure gas flow into the combustion chamber from the ends of the tubes is generally not controlled so as to create a "mixing" effect within the combustion chamber. Because there is no flow control, the amount of time the impure gas remains in the combustion chamber (i.e. "time at temperature") will vary throughout the abatement cycle. A varying "time at temperature" for the impure gas can create the problem of incomplete oxidation of the VOC's.

SUMMARY OF THE INVENTION

It is therefore an object of the present invention to provide an improved single unit regenerative incinerator which provides a flow control for complete oxidation of contaminants.

It is also an object of the present invention to provide a single unit regenerative incinerator which provides a structural flow control for combustion chamber exhaust.

The present invention provides a fume incinerator which comprises a housing having an upper and lower end, a tube sheet internally affixed to the housing for defining a plenum in the lower end of the housing, and an inlet pipe for feeding ambient fumes containing volatile organic combustible contaminants into the plenum. A combustion chamber is located in the upper end of the housing for oxidizing the volatile organic combustible contaminants in the fumes and outputing a hot exhaust. A burner is attached to the combustion chamber for admitting a combustion fuel into the combustion chamber. A plurality of heat exchange tubes are affixed to the tube sheet for delivering the fumes in the plenum to the combustion chamber, and an outlet pipe is connected to the housing, intermediate the lower and upper ends, for expelling the hot exhaust. A baffle is affixed to the housing proximate the combustion chamber for evenly directing the hot exhaust between the housing and the outer surfaces of the plurality of tubes to the outlet pipe, thereby heating the ambient fumes inside the plurality of tubes and cooling the hot exhaust.

The present invention will be more fully understood upon reading the following detailed description of the preferred embodiment in conjunction with the accompanying drawings.

DETAILED DESCRIPTION OF THE PREFERRED EMBODIMENT OF THE INVENTION

Figure 1:
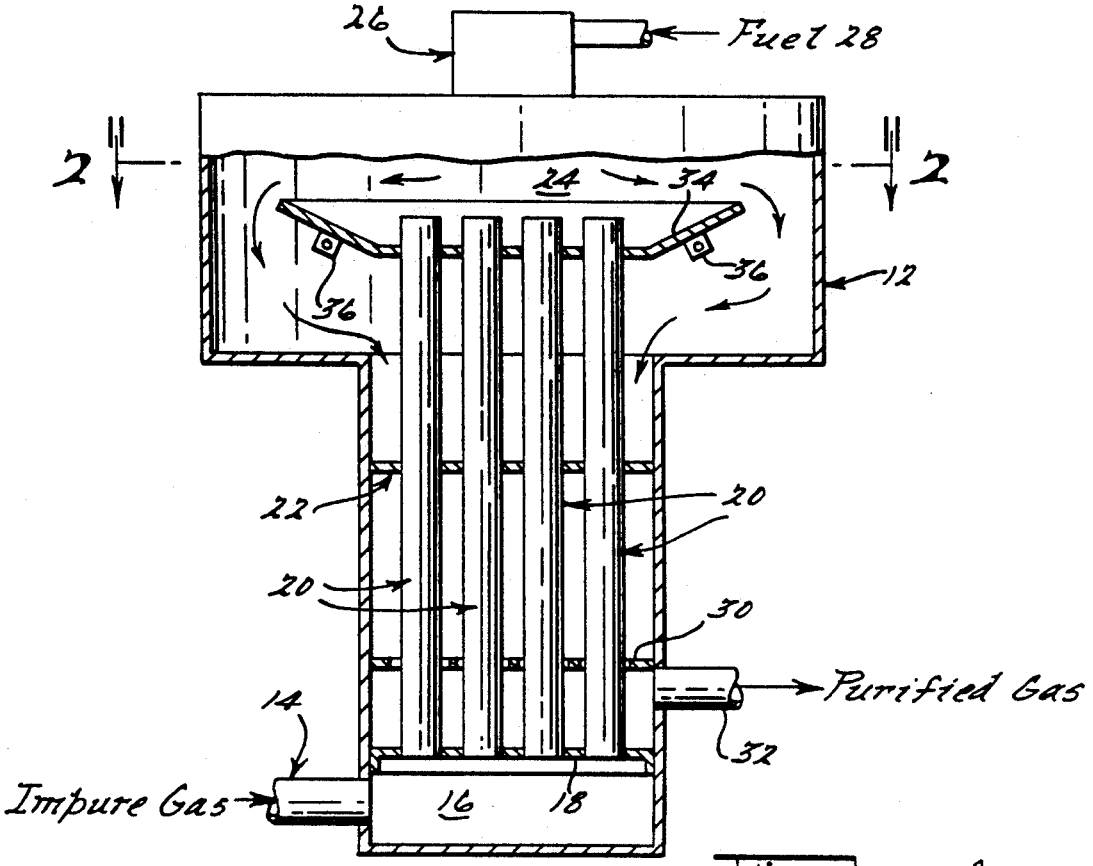
FIG. 1 is a side elevational, partially in section, of a fume incinerator utilizing an impinged baffle in accordance with the present invention.
Figure 2:
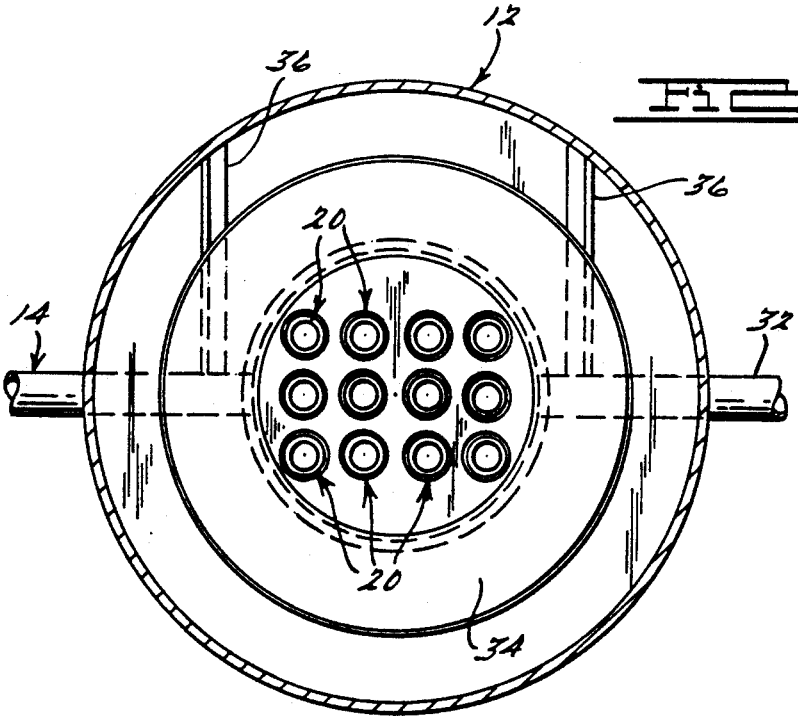
FIG. 2 is a cross-sectional view taken along the line 2—2 of FIG. 1.

Referring to FIG. 1, a single unit, shell and tube fume incinerator 10 in accordance with the present invention comprises an enclosure 12 having an inlet pipe 14 and a plenum 16 at the lower end thereof. A tube sheet 18 at the lower end of a set of tubes 20 affixes the lower end of the tubes to the enclosure 12. Tubes 18 can be cylindrical as shown, or square shaped. The top ends of the tubes are guided against excessive lateral motion by a set of transverse support members 22. The support members 22 are affixed to the housing 12 as by welding. The impure gases are input into plenum 16 from inlet pipe 14. The gases then flow into tubes 20 and subsequently injected from the ends of tubes 20 into a combustion chamber 24. A burner 26 regulates and supplies a fuel 28 to combustion chamber 24, which heats the gases within the chamber 24 to a desired combustion temperature. Generally, a suitable combustion temperature is approximately 1400° F. (760° C). As the gases flow downwardly, they pass uniformly over the outside (i.e., the outer perimeter) of all of the tubes 20, thereby creating a heat exchange effect. Overall operation will be explained in more detail hereinbelow.

The gases from the combustion chamber 24 begin to cool as soon as they enter the space around the tubes 20 due to a counterflow heat exchange process. The housing 12 surrounding the bundle of tubes has a diameter such that the gas velocity outside of tubes 20 is about the same as the velocity inside of tubes 20. This provides a beneficial balance between pressure drop and heat transfer inside incinerator 10. The effective heat transfer area is determined by the amount of area within housing 12 having tubes 20 extending therein. This area defines the counterflow heat exchanger.

To facilitate removal of the cleansed exhaust gas from incinerator 10, a lower baffle 30 is disposed just above the tube sheet 18 to convert the uniform downward exhaust gas flow to a controlled horizontal flow. The controlled horizontal exhaust gas flow exits incinerator 10 at a heat exchanger vent pipe 32. The tubes 20 extend through corresponding openings cut into lower baffle 30. To generate the desired fast flow conversion, the diameters of the openings are progressively decreased in size with the largest diameter opening being the furthest away from vent pipe 32. The progressively decreasing diameter sizes creates progressively decreasing clearances between tubes 20 and the lower baffle openings. The decreasing clearances cause changes in gas flow pressure thereby converting the uniform downward gas flow to a controlled horizontal gas flow.

In accordance with the present invention, an upper baffle 34 is affixed to the housing 12 as by a suitable structural fastening means, e.g., flange/bolt combinations 36. Upper baffle 34 is utilized to control the flow of hot exhaust gas from the combustion chamber 24. Upper baffle 34 can be flat, tubular, or conical (as shown in FIG. 1) to add stiffness. Each tube 20 passes through a corresponding hole in the upper baffle 34, and preferably extends about 1 or 2 inches (≈2.5 to 5 cm) above the upper baffle 34. Tubes 20 are not fastened to the baffle as would be done with the tube sheet, but have a slip fit so the tubes 20 can move axially to accommodate thermal expansion of the tubes. Below the upper baffle 34, the housing 12 constricts exhaust gas flow so that the hot air which has passed around the upper baffle 34 must flow into the outer perimeter of the tube bundle (i.e., the space between tubes 20 and housing 12). The use of upper baffle 34 does not provide an exact counterflow at the ends of tubes 20. However, this is not problematic due to the achieved thermal expansion capability of each tube 20 relative to upper baffle 34.

Operation of the incinerator 10 will now be more fully described. In accordance with the present invention, impure gases typically containing air, VOC's and perhaps other compounds are fed into the bottom of incinerator 10 to the plenum 16 below the tube sheet 18. A regenerative heat exchange process occurs as the gases rise up the inside of tubes 20. The gases are preheated from ambient temperature (100° F./≈37° C.) to approximately the combustion temperature (≈1200° F./≈648° C.) by the down flowing hotter gases which exit the combustion chamber 24. As the feed gases reach the combustion temperature, the VOC's will start to burn and raise the gas temperature thereof. The combustion temperature varies with the type of impurities but is typically 900° F. to 1200° F. (≈482° C. to ≈648° C). The fuel 28 (and air) fed to the burner 26 provides enough energy to raise the gas temperature to the desired combustion temperature (typically 1400° F. (760° C.). Radiation or flow of the mixing products throughout combustion chamber 24 provides an even temperature within the chamber 24. Combustion is completed in the combustion chamber 24, and in the top portion of tubes 20.

The gas flow from the ends of tubes 20 promotes mixing within combustion chamber 24. However, this gas flow also causes the problem of varying the amount of time the gas (and therefore the VOC's) remain in the combustion chamber 24. This in turn causes difficulty in controlling the "time at temperature" of the gas to ensure complete oxidation of the VOC's. A higher operating temperature can somewhat compensate for a variable or potentially short time at temperature, but this can lead to damage of tubes 20.

In accordance with the present invention, the use of upper baffle 34 gives a definite time at temperature as the gases flow radially outward, around the edge of the baffle and radially inward without increasing the incinerator operating temperature. Upper baffle 34 ensures the complete combustion of the VOC contaminants. The hot gases then flow downward around the outside of the tubes thereby creating the regenerative heat exchange effect. Since flows are essentially uniform both inside and outside tubes 20, local overheating is minimized. If mild overheating does occur (i.e., on the outside of the tube bundle), sliding of the tube ends within the baffle 34 will compensate for expansion of the heated tubes.

The present invention particularly improves the oxidation process within a single unit shell and tube heat exchange regenerative incinerator by controlling the flow of combustion chamber exhaust to provide a definite time at temperature.

It will be understood that the foregoing description of the preferred embodiment of the present invention is for illustrative purposes only, and that the various structural and operation features herein disclosed are susceptible to a number of modifications none of which departs from the spirit and scope of the present invention as defined in the appended claims.

I claim:

1. A fume incinerator comprising:

a housing having an upper and lower end;

an inlet pipe for feeding ambient fumes containing volatile organic combustible contaminants into the lower end of said housing;

a combustion chamber in the upper end of said housing, said combustion chamber oxidizing said volatile organic combustible contaminants in said fumes and outputing a hot exhaust;

a plurality of heat exchange tubes affixed only to the lower end of said housing, said plurality of tubes delivering said fumes from the lower end of said housing to said combustion chamber;

an outlet pipe connected intermediate the lower and upper ends of said housing for expelling said exhaust from said incinerator; and, a baffle affixed to said housing proximate said combustion chamber for evenly directing said hot exhaust between said housing and the outer surfaces of said plurality of tubes to said outlet pipe thereby heating said ambient fumes inside said plurality of tubes and cooling said hot exhaust.

2. The fume incinerator of claim 1 wherein said plurality of tubes extend in a slip-fit relation through a corresponding plurality of holes located in said baffle to compensate for thermal expansion of said plurality of tubes.

3. The fume incinerator of claim 1 wherein said baffle directs the flow of hot exhaust within said combustion chamber to provide a sufficient length of time said hot exhaust remains in said combustion chamber, thereby facilitating complete oxidation of said volatile combustible contaminants.

* * * * *